United States Patent [19]

Hickman

[11] Patent Number: 4,926,399

[45] Date of Patent: May 15, 1990

[54] TRANSDUCER MOUNTING SYSTEM

[76] Inventor: Ravis S. Hickman, 10042 Mesita Dr., Dallas, Tex. 75217

[21] Appl. No.: 331,266

[22] Filed: Mar. 30, 1989

[51] Int. Cl.[5] ..... H04R 1/44

[52] U.S. Cl. ..... 367/173; 248/231; 248/291; 248/682

[58] Field of Search ..... 367/16, 17, 173, 104, 367/107, 106, 120, 130; 248/1, 359 R, 359.5, 360, 324, 309.1

[56] References Cited

U.S. PATENT DOCUMENTS

| | | | |
|---|---|---|---|
| 3,729,162 | 4/1973 | Salvato | 367/173 |
| 3,880,106 | 4/1975 | Farmer | 367/165 |
| 4,152,690 | 5/1979 | Veatch | 367/173 |
| 4,282,590 | 8/1981 | Wingate | 367/173 |
| 4,285,485 | 8/1981 | Burke | 367/173 |

*Primary Examiner*—Brian S. Steinberger
*Attorney, Agent, or Firm*—Johnson & Gibbs

[57] ABSTRACT

A transducer mounting system for permitting the remote pivotal actuation of an underwater signal transducer. The mounting bracket permits a wide variety of transducers to be mounted upon a conventional trolling motor and remotely actuated by an operator in the boat. Actuation of the bracket directs the transducer of a conventional fish locator or depth finder of the acoustic variety for locating fish or other objects therearound. By securing the bracket to the trolling motor, one axis of orientation of the transducer is automatically indicated by the orientation of the trolling motor. Concomitant angulation of the bracket and transducer affixed thereto will thereby permit the operator to precisely locate desired objects such as fish in the direction indicated by the trolling motor.

5 Claims, 3 Drawing Sheets

TRANSDUCER MOUNTING SYSTEM

BACKGROUND OF THE INVENTION

1. Field of the Invention

The present invention pertains to mounting brackets and, more particularly, to a pivotal mounting assembly for a marine depth finder transducer assembly.

2. History of the Prior Art

It is well known in the prior art to utilize high frequency energy for the determination of marine depth as well as objects such as fish in the water therearound. The acoustic systems are generally constructed with a signal transducer that is mounted to a motor or the boat itself for emitting the high frequency energy therefrom and receiving the reflection thereof. The source of the energy is generally located within the boat and coupled to the transducer by a flexible conducting cable. A similar conducting wire provides the output of the transducer to the operator through a visual display screen or the like. In many instances alarms and more fanciful display apparatus are incorporated. These are generally provided for facilitating the use thereof in finding the configuration of the marine bottom or objects such as fish and logs.

In more recent times, the depth location transducer has been utilized for locating fish in marine environment. This is done by effectively orienting the depth finder to a region beneath the boat so that the operator sees not only the depth but the objects moving between the boat and the marine depth. Generally high frequency energy is generated and transmitted from the transducer through the water. Reflections thereof are received by the transducer and carried back to the control panel where the display is presented to the user. Certain modifications of this assembly have included angled brackets which permit the permanent angled mounting of the transducer adjacent a motor or boat hull fitting and permits a different angle to the detection pattern. In this way the operator is able to see either ahead of the boat travel or to the sides or behind, depending on the orientation of the bracket. This permits the operator to easily locate underwater objects. It may be assumed that a permanent angled bracket would not permit the versatile exploration of the surrounding waters in a manner convenient to the fishing.

It is known in the prior art to take such signal transducers and secure them to the end of poles that may be placed in the water. These poles may be directed to particular areas to point out fish. With the poles being manipulated by the arms of the user, the user is not free to fish. This means that in the event a particular region is found to contain fish, the user must remove the pole from the water, drop it and then pick up the fishing pole to cast in the direction of the fish.

It is yet a more distinct advantage to provide the fisherman with the ability to direct the angle of fish finding exploration through the direction of the trolling motor. It is well known that operations of the trolling motor often are regulated by foot actuated devices. A foot actuation of the motor frees the hands of the user for fishing. The present invention provides such an improvement by the utilization of remotably angulatable bracket that can be mounted directly to the trolling motor.

SUMMARY OF THE INVENTION

The present invention pertains to a pivotal bracket for a fish finding transducer adapted for securement to a trolling motor and remotely actuatable linkage therewith. More particularly, the present invention pertains to a pivot bracket adapted for receiving any of many conventional transducers thereon and for being directly secured to the cowling of a conventional trolling motor. Securement linkages are provided for permitting the control cable to extend away from the cowling of the trolling motor to a remote actuation mechanism disposed within the boat and accessible to the fisherman. By changing the orientation of the trolling motor and controlling the actuation cable for the transducer mounting bracket, the fisherman is able to accurately detect possible fish in any particular area in a fast and efficient manner. The mounting bracket is constructed with a rib section particularly adapted for the generally cylindrical housing of the trolling motor and a flexible strap is supplied therewith for facilitating the securement of the mounting bracket to any number of housing sizes. The mounting bracket is further constructed for ease in assembly and with sufficient versatility for the mounting of a large number of transducers thereon.

BRIEF DESCRIPTION OF THE DRAWINGS

For a more complete understanding of the present invention and for further objects and advantages thereof, reference may now be had to the following description taken in conjunction with the accompanying drawings and which.

DETAILED DESCRIPTION

Figure 1:
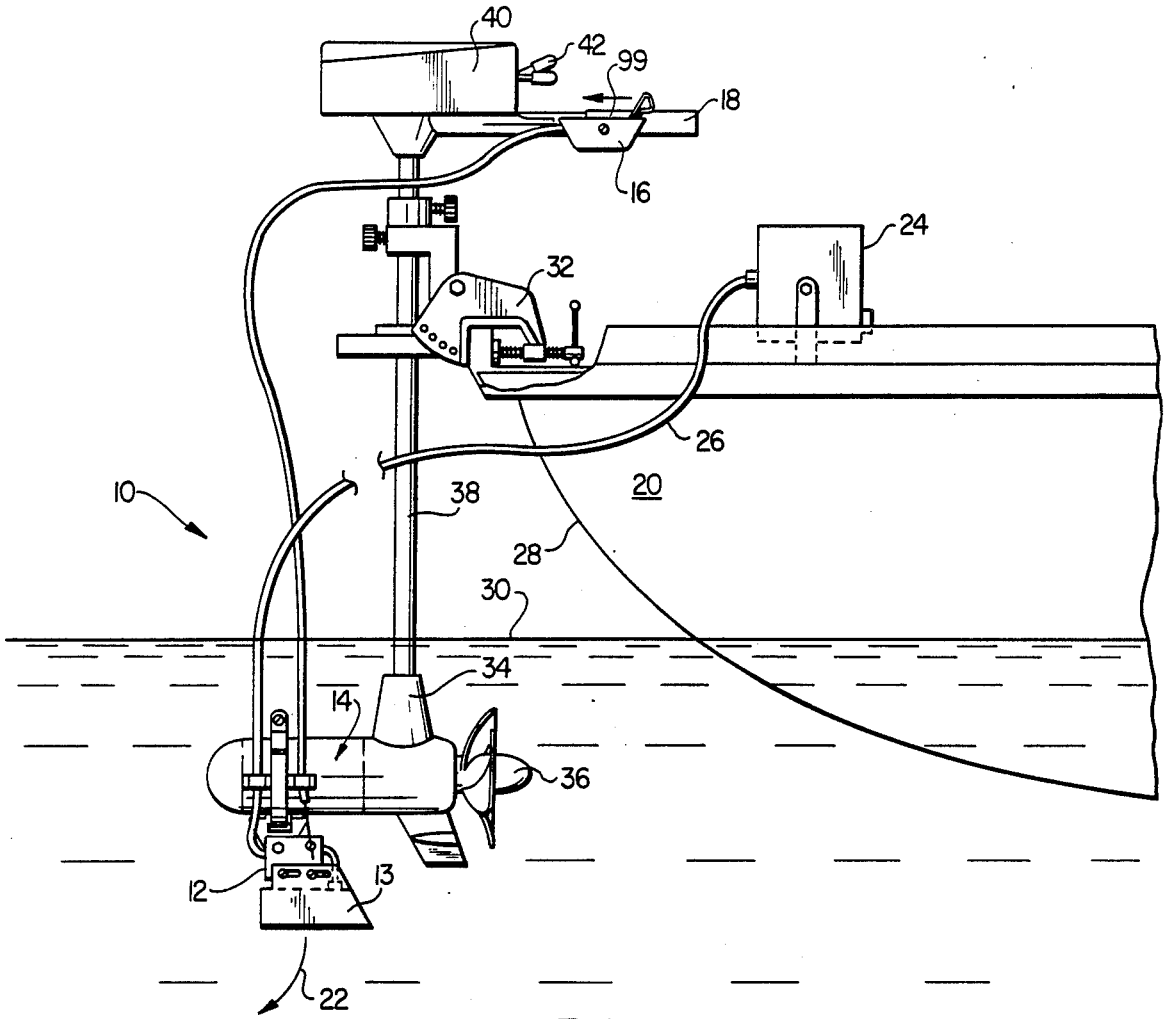
FIG. 1 is a side elevational view of the transducer mounting system of the present invention shown secured to a trolling motor mounted to a boat illustrating the principles of the present invention.

Referring first to FIG. 1 there is shown a side elevational view of the system 10 constructed in accordance with the principles of the present invention. The system 10 comprises a transducer mounting assembly 12 upon which a transducer 13 is securely mounted. The mounting assembly 12 is secured to a trolling motor 14 and actuated by an actuation mechanism 16 mounted to the trolling motor handle 18. The upper region, including the handle 18, is adjacent to the end of a boat 20 whereby it is operable by a fisherman or user (not shown). The trolling motor is securely mounted to boat 20 by conventional mounting means and therewith provides an ability to the user to both propel and steer the boat 20 to the desired area of water for purposes of fishing and the like. By actuating the transducer 13 through utilization of actuation mechanism 16, the angle of the transducer 13 may be selectively varied as indicated by arrow 22. Angulation of the transducer 13 in the direction of arrow 22 will thereby vary the image produced on the screen or display unit 24 mounted in the boat 20. A coupling cable 26 connects the transducer 13 and the display unit 24 for providing the visual and/or audible output to the fisherman to enable him to precisely locate objects in the water such as fish or the like.

Operation of the trolling motor 14 requires providing power thereto and the proper orientation thereof. The placement of the trolling motor 14 is preferably at the bow 28 of the boat 20. This mounting at the bow 28 is provided such that the lower region of the trolling motor 14 is beneath the water level 30 and is generally afforded by a standard mounting assembly 32 secured to the boat 20. In this configuration the underwater housing 34 has secured thereto a propeller 36 which is powered by a power supply in the boat (not shown) providing a propulsive force to the trolling motor 14 and the boat 20 connected thereto. The propulsion is obviously in the direction of the axial alignment of housing 34 which orientation is controlled by the shaft 38 coupling the drive mechanism 40 thereabove. Drive or control mechanism 40 mounted above shaft 38 further includes operating control 42 which may be actuated by hand or by conventional foot actuation devices (not shown). Foot operated devices are conventional in trolling motor designs and permit the fisherman to vary the orientation of the trolling motor housing 34 beneath the water level 30 as well as the power applied thereto. In this manner the fisherman's hands are free for holding a fishing pole and engaging in the activity of fishing. The fisherman may either stand or sit in the boat 20 and one's feet, which ordinarily are not required for fishing, may control the total direction and propulsion of the boat.

In accordance with the principles of the present invention control of the trolling motor 14, and particularly the angle of the orientation of the housing 34 beneath the water level 30, provides the direction in which the boat 20 will travel and the mounting assembly 12 provides means for the fisherman to observe, through control unit 24, the underwater region in front of or around the trolling motor 14 prior to its movement therethrough. The invention permits the operator to locate fish for purposes of fishing as well as objects for purposes of avoiding said objects to prevent damage to the trolling motor as well as the transducer 13. Although it is conventional to directly mount transducers to trolling motors and the like in a fixed, predefined orientation thereon, the present invention provides for a selectable orientation, whereby the operator can view the underwater regions in front of, around and below the trolling motor during operation.

By way of example only, one fish locating system tested in association with the present invention and currently on the market today, is sold under the trademark "Hummingbird." There are, of course, many other systems that can be used herewith; and several of these have also been used and tested.

Figure 2:
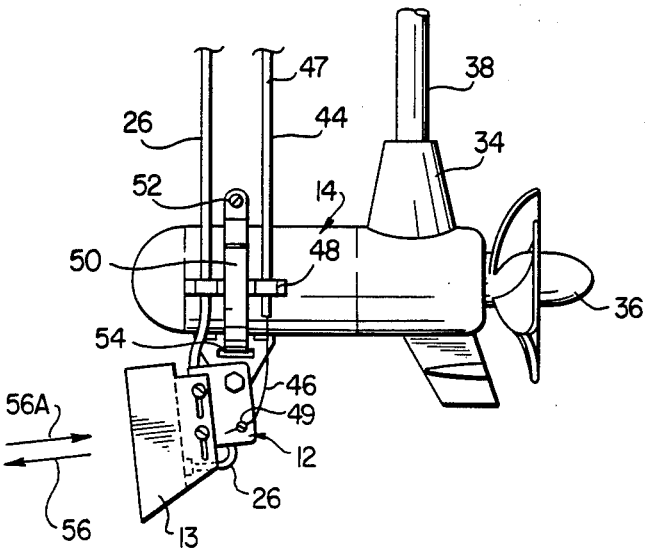
FIG. 2 is an enlarged fragmentary view of the trolling motor and transducer mounting bracket of FIG. illustrating the pivotal actuation thereof.

Referring now to FIG. 2 there is shown an enlarged, side elevational fragmentary view of the system 10 of the transducer mounting assembly 12 and trolling motor 14. The transducer mounting assembly 12 is coupled to actuation linkage 16 mounted to the handle 18 by coupling control cable 44. The control cable 44 is assembled with a wire 46 which moves through an outer cable sheath 47. The end of the wire 46 is secured to a clamp 49 mounted directly to the mounting assembly 12. A strap 50 secures the transducer assembly 12 directly to the housing 34 of the trolling motor 14. The clamp 50 is secured about the trolling motor by securing means such as threaded fastener 52. In one embodiment of the present invention strap 50 and clamp 52 comprise a conventional cable clamp having a threaded mounting configuration. Cable clamps are, by definition, flexible in design and constructed to adapt to a myriad of sizes as well shapes. Thus, such an embodiment is incorporated in the present invention as one means for securing the transducer assembly 12 to the trolling motor 14. The lower region of strap 50 is secured through a mounting slot 54 formed in the mounting assembly 12. In this manner the direction of energy transmission from transducer 13 and its receipt as shown by arrow 56 may be selectively varied by variation in the length of wire 46 between cable clamp 48 and clamp 49. As shown most clearly in this drawing the angular relationship between signal arrows 56 and 56A and the propulsive effect of propeller 36 is carefully maintained and axially aligned. This axial alignment between the propulsive effect of propeller 36 and the signal direction 56 of transducer 13 facilitates use of the present invention during both operation of the boat 20 and unpowered fishing therewith. In accordance with one aspect of the present invention, the trolling motor may be shut off and while fishing with an unpowered boat 20, the transducer may be angulated and rotated for observing objects such as fish in the surrounding water.

Figure 3:
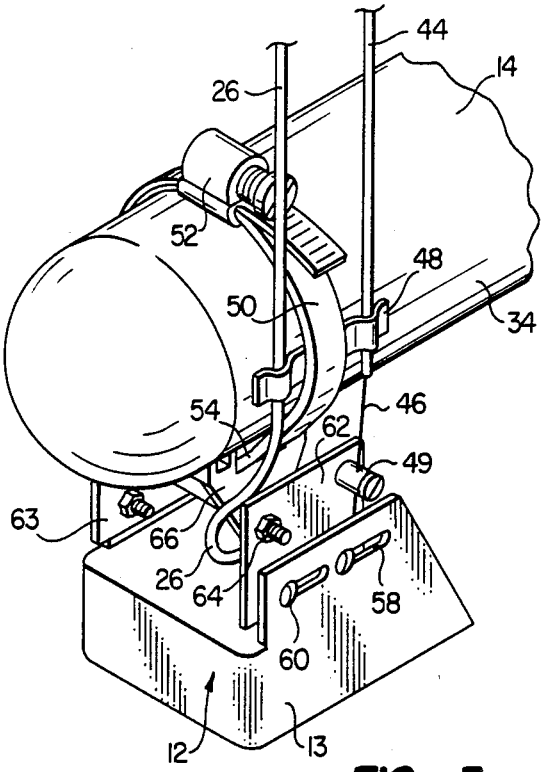
FIG. 3 is an enlarged fragmentary, perspective view of the trolling motor and mounting bracket of FIG. 2 further illustrating the securement of the mounting bracket to the trolling motor and the operation of the mounting bracket therewith.

Referring now to FIG. 3, there is shown an enlarged perspective, fragmentary view of the trolling motor and mounting assembly of FIG. 2. In this illustrative figure, the transducer 13 is shown to be constructed with mounting slots 58. The mounting slots 58 allow securement by threaded fasteners such as bolts 60 or the like. In the present invention, the mounting structure of mounting assembly 12 comprises a pair of plates 62 and 63 that are configured for adapting to a plurality of mounting configurations of transducer 13. The plates 62 and 63 are thus constructed with a plurality of holes, to be defined in more detail below, for purposes for receiving both the threaded fasteners 60 for mounting the transducer 13 thereto as well as the securement of pivotal shaft 64 as shown herein. The shaft 64 connects the opposite plates 62 and 63 which are disposed in generally parallel spaced relationship beneath the trolling motor 14. A mounting bracket 66 is disposed adjacent the plates 62 and 63, and in this particular configuration, sandwiched therebetween. This sandwiching configuration may be seen to vary the width at which plates 62 and 63 are outwardly disposed for engaging the mounting bracket or slots 58 of the transducer 13. This aspect is particularly illustrated in discussion of FIGS. 5A–5C.

The bracket 66, as described in more detail below, has an aperture formed on the opposite side wall flanges thereof for receipt of mounting shaft 64 therethrough. The mounting shaft permits pivotal actuation of the plates 62 and 63 about the mounting bracket 66 pursuant to movement of the wire 46 which is secured to plate 62 by clamp 49. Relative movement of the wire 46 is provided by virtue of the clamping of the clamp 48 on the cable sheath 47 of the cable 44. The strap 50 is likewise shown herein in a perspective view further illustrating the placement of the fastening and adjustment means 52. The construction of the strap and adjustment means 52 is seen to depict a conventional cable clamp assembly such as that provided in the prior art for clamping automotive hoses and the like. Because strap 50 is flexible it may automatically conform to secure the mounting strap 48 to the trolling motor 14 as well as adjusting to variations in sizes and shapes of the trolling motor housing.

Figure 4:
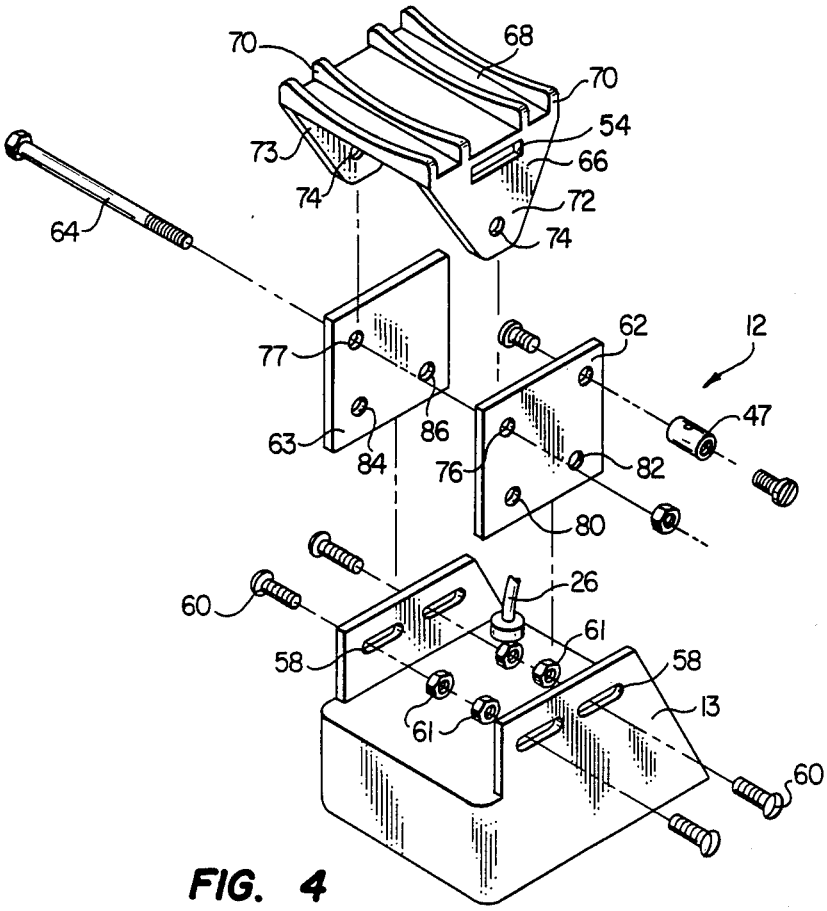
FIG. 4 is an enlarged, exploded, perspective view of the mounting bracket and transducer assembly of FIG. 3 illustrating the manufacture and assembly thereof in accordance with the principles of the present invention.

Referring now to FIG. 4, there is shown an exploded perspective view of the transducer mounting assembly 12 of FIG. 3. Plates 62 and 63 are shown in a position exploded upwardly of the transducer 13 further illustrating the utilization of bolts 60 for securement thereto. In this vane, threaded fasteners such as nuts 61 are shown herein for illustrating the securement means to be used therewith. Transducer coupling cable 26 is likewise shown. This coupling configuration was not otherwise seen with such clarity in the figures above. Also shown most clearly in this configuration is the mounting bracket 66 which is constructed with a top 68 having a plurality of arcuate ribs 70 formed thereon. The arcuate shape of the ribs 70 is adapted for matingly engaging the cylindrical configuration of the trolling motor 14 for secured mounting thereto. Depending from top 68, in generally orthogonal relationship thereto, are opposite sides 72 and 73. Sides 72 and 73 are both constructed with aligned apertures 74 adapted for matingly receiving the mounting shaft 64 therethrough as shown in FIG. 3 above. The mounting shaft 64 is likewise received through aperture 76 and 77 formed in plates 62 and 63, respectively. The engagement of the apertures 76, 77, and 74 of the respective plates 62, 63 and sidewall 72 and 73 provide a pivotal relationship permitting the pivotal movement of the transducer 13 described above.

Referring still to FIG. 4 the side plates 62 and 63 are further constructed with apertures 80, 82, 84 and 86. Apertures 80 and 82 are adapted for receiving the threaded fastener 60 of slots 58 on a first side of transducer 13. Likewise, apertures 84 and 86 of side plate 63 are adapted for receiving the threaded fastener 60 through the slots 58 aligned in registry with transducer 13. In this mounting configuration the plates 62 and 63 are configured for matingly engaging the mounting bracket 66 as described above. The utilization of threaded fasteners 60 and nuts 61 are, of course, provided herein for purposes of illustration only, in that other embodiments of fastening means and fastening aperture configurations are contemplated by the spirit and scope of the present invention. It should, however, be specifically noted that this mounting configuration does provide a single pivotal axis about shaft 64 affording the select controlled actuation of transducer 13 remote to the trolling motor handle 18 described above.

Figure 5A:
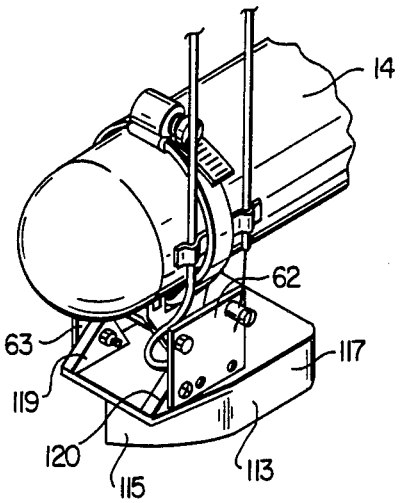
FIGS 5A–5C illustrate the mounting of three different transducers in accordance with the principles of the present invention.
Figure 5B:
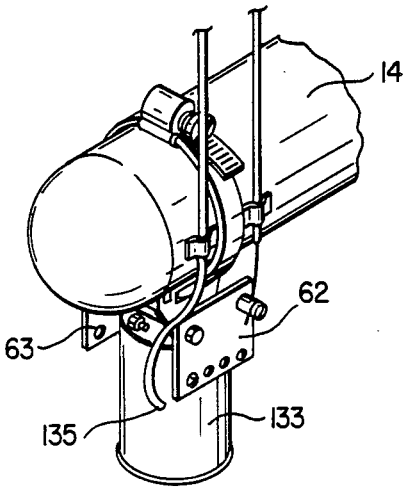
Figure 5C:
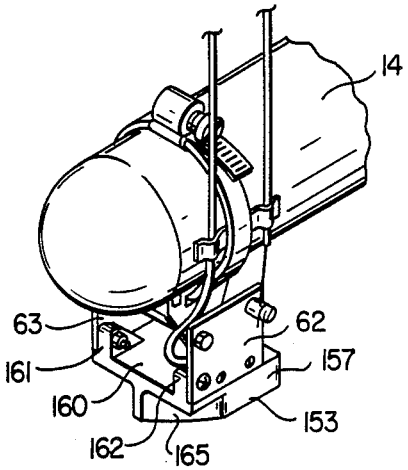

Referring now to FIGS. 5A–C there is shown a series of transducer mountings. In each case the configuration of the transducer 13 is changed. These are configurations that are currently in use at the time of filing of the subject patent application. In FIG. 5A, transducer 113 has a tapered frontal region 115. The rear region 117 of the transducer 113 is substantially rectangular in cross section. The mounting of the transducer requires a variation in the placement of panels 62 and 63. Likewise, panel 62 may be seen to incorporate an additional spacing of apertures therein. As noted above, any number of aperture arrays are contemplated in panels 62 and 63 in accordance with the principles of the present condition. Likewise, the panels 62 and 63 may be mounted outwardly of the transducer mounting flanges 119 and 120. Again, the transducer flanges 119 and 120 may be sandwiched between panels 62 and 63. The mounting relative to the trolling motor 14 is otherwise not varied from that described above.

FIG. 5B illustrates the trolling motor 14 with yet another embodiment of a transducer mounted thereon. Transducer 133 is of a generally cylindrical configuration. Panels 62 and 63 are likewise mounted outwardly of the mounting flanges of the generally cylindrical transducer 133 and again a variation in the hole pattern in panel 62 is shown. The location of the transducer coupling cable terminating at point 135 is likewise a variation from that described for the other transducer configurations shown above. It may be seen that the cylindrical mounting configuration provides yet another shape that is shown to be easily used with the mounting assembly 12 of the present invention.

In FIG. 5C the trolling motor 14 is shown mounted with yet another alternative embodiment of a transducer 153. Transducer 153 has a distinctly different shape, having a tapered frontal region 155 and a substantially rectangular shaped rear portion 157. However, the top portion 160 incorporates a pair of outward mounting flanges 161 and 162. These mounting flanges 161 and 162 are adapted for direct engagement with panels 62 and 63, respectively, as shown herein. As shown in FIGS. 5A–5C, collectively, a wide variety of transducer sizes and shapes may be mounted to the transducer mounting assembly 12 of the present invention. Variations in width can easily be accommodated by standard commercial washers and the like interposed between the respective panels 62 and 63 and the respective mounting flanges of the various transducers.

In operation, the trolling motor 14 is conventionally mounted to the boat 20 by mounting clamp 32. It is connected to its power supply (not shown) in the boat and adapted for operation by virtue of the controls 42 disposed adjacent to the control unit 40 or by the foot pedal actuation means (not shown) described above. Rotation or movement of the handle 18 thereby facilitates controlled angulation and orientation of the housing 34 beneath the water level 30 through rotation of the coupling shaft 38. The placement of the transducer assembly 12 beneath the trolling motor 14 then permits select angular actuation thereof in the direction of arrow 22, as shown in FIG. 1, by the lever mechanism 16. As stated herein, movement of the trolling motor both from an orientation standpoint by rotation of shaft 38 and angulation of the transducer 13 by the actuation mechanism 16 can occur while the trolling motor 14 is engaged for powering the boat 20 or when it is not engaged. In either mode of use, the fisherman is able to observe objects under the water 30 by the display unit 24 and knows precisely which region the display unit 24 depicts the underwater environment by virtue of not only the angle but also the orientation of the handle 18 indicative of the direction of the underwater housing 34. In essence, the angle 18 defines the direction in which the transducer 13 is pointing and the position of the mechanism 16 affords the user knowledge as to the area either below or in front of the boat.

Addressing now the various components of the present invention and equipment related thereto, the transducer mounting assembly 12 and the parts described in FIGS. 3 and 4 may be constructed of aluminum, stainless steel or the like. It is preferable that noncorrosive materials be incorporated both in side plates 62, 63 and mounting bracket 66 as well as the threaded fastener 60 and nut 61. Because the transducer 13 is typically constructed for underwater application its coupling cable 26 is generally water tight, which is conventional in the prior art. The utilization of cable clamps 48 is known to be conventional and the securement of the cable sheath 47 of cable 44 should be understood by the description set forth above. The aspect of obviousness of the use of a transducer beneath a trolling motor 14 is likewise addressed herein. As said above, it is known to securely mount transducer 13 to trolling motors as well as various regions of the boat 20. What is not known in the prior art, is the mounting of the transducer mounting assembly 12 for purposes of remote actuation of the transducer 13 concomitantly with select orientation of the trolling motor 14, which remote actuation can occur in the boat 20 by the fisherman. Other prior art embodiment segregating the transducer 13 and requiring its movement in the water on the end of a separate pole, or the like, requires use of the hands of the fisherman which obviously interferes with the fishing endeavor and does not provide the features describes above of both safety and convenience in use of the trolling motor.

Figure 2A:
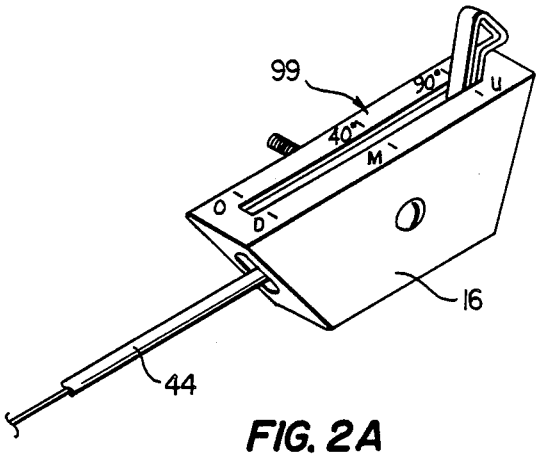
FIG. 2A is an enlarged perspective view of the actuation mechanism of FIG. 1.

Likewise, it should be noted that other mounting configurations in both the trolling motor and the mounting bracket 12 are contemplated in accordance with the spirit and scope of the present invention. Both the cable actuation lever mechanism 16 as well as the particular shapes of the mounting brackets may vary. In fact, one aspect of the present invention includes a series of indicia disposed upon the top surface 99 of the actuation mechanism 16, as shown in FIG. 2A, which will permit a degree of knowledge to be imparted to the fisherman in actuating said mechanism. The indicia 99 may include the degrees of angulation, 0° , 45°, 90° or reference to the direction of observation; (D) down; (M) middle; (U) up. Other indicia may, of course, be used. Other indicia of transducer angulation in the direction of arrow 22 of FIG. 1, may likewise be provided in accordance with spirit and scope of the present invention.

It is thus believed that the operation and construction of the present invention will be apparent from the foregoing description. While the method and apparatus shown or described has been characterized as being preferred it will be obvious that various changes and modifications may be made without departing from the spirit and scope Of the invention as defined in the following claims.

What is claimed is:

1. A signal transducer position control system for a signal transducer adapted to be mounted to a trolling motor secured to a boat and to be submerged beneath a water level therearound, said system comprising:

a transducer mounting assembly adapted for the securement of said transducer thereto, said transducer mounting assembly comprising a first mounting bracket adapted for securement to the underneath of said trolling motor and a plurality of transducer mounting plates adapted for pivotal securement to said first mounting bracket and to said transducer, said transducer mounting plates comprising first and second panels each having a plurality of apertures formed therethrough adapted for receiving mounting means for securement of said transducer thereto and for receiving pivoting means to permit pivotal movement of said mounting plates relative to said first mounting bracket;

means for securement of said mounting assembly to said trolling motor in predetermined alignment therewith;

pivot means associated with said mounting assembly for permitting relative pivotal movement of said transducer relative to said trolling motor; and means for remotely actuating said transducer with said transducer mounting assembly, said remote actuation means comprising an actuation cable, one end of which is secured to said mounting assembly adjacent said transducer and the other end of which is positioned in said boat for the actuation thereof by the user, and wherein said panels are constructed with at least three apertures therethrough, said pivot shaft being adapted for passage through said first mounting bracket for the pivotal mounting of said panels therewith.

2. The apparatus as set forth in claim 1 wherein said transducer mounting assembly is secured to said trolling motor by a flexible strap.

3. The apparatus as set forth in claim 1 wherein said transducer mounting assembly comprises a second mounting bracket constructed with a top region adapted for matingly engaging the trolling motor and first and second pivot panels adapted for securement of said transducer thereto and the pivotal mounting thereof relative to said first mounting bracket.

4. The apparatus as set forth in claim 3 and further including a cable secured at one end to one of said panels and at a second end to an actuation assembly placed in said boat for the actuation thereof in a control orientation of said transducer therefrom.

5. The apparatus as set forth in claim 4 wherein said actuation assembly positioned in said boat further comprises indicia thereon provided an indication of the angulation of said transducer relative to said trolling motor.

* * * * *